US006132252A

United States Patent [19]

Chaillot

[11] Patent Number: 6,132,252

[45] Date of Patent: Oct. 17, 2000

[54] ELECTRICAL CONNECTOR WITH LOCKING OF THE CONTACT TERMINALS

[75] Inventor: Georges Chaillot, Nogent le Roi, France

[73] Assignee: Framatome Connectors International, Courbevoie, France

[21] Appl. No.: 09/303,952

[22] Filed: May 3, 1999

[30] Foreign Application Priority Data

May 5, 1998 [FR] France ..... 98 05927

[51] Int. Cl.[7] ..... H01R 13/424

[52] U.S. Cl. ..... 439/595; 439/752

[58] Field of Search ..... 439/595, 752

[56] References Cited

U.S. PATENT DOCUMENTS

| | | | |
|---|---|---|---|
| 5,085,599 | 2/1992 | Maejima et al. | 439/595 |
| 5,199,902 | 4/1993 | Kahle et al. | 439/595 |
| 5,281,168 | 1/1994 | Krehbiel et al. | 439/595 |
| 5,586,917 | 12/1996 | Yagi et al. | 439/752 |

FOREIGN PATENT DOCUMENTS

| | | |
|---|---|---|
| 0310487 B1 | 4/1989 | European Pat. Off. . |
| 0344691 A2 | 12/1989 | European Pat. Off. . |
| 0525171 B1 | 2/1993 | European Pat. Off. . |
| 0767515 A2 | 4/1997 | European Pat. Off. . |
| 2 754 943 | 4/1998 | France . |

*Primary Examiner*—T. C. Patel
*Attorney, Agent, or Firm*—Perman & Green, LLP

[57] ABSTRACT

Electrical connector provided with a casing having a front face and a rear face and having at least one row of cavities, accommodating female contact terminals, provided with first holes (30) emerging in the front face of the casing, and at least one of the walls of which has at least one elongate thin region forming a column (34) separated form the rest of the wall by slots parallel to the direction of insertion of the contact terminals into the cavities, this thin region being provided with an internal lug (36) to be engaged in a window in the terminals, the connector being furthermore provided with secondary locking means for the contact terminals, these secondary locking means consisting of studs (41) that can be moved perpendicular to the direction of insertion of the terminals between a parted position of the columns and a bearing position of the columns.

11 Claims, 4 Drawing Sheets

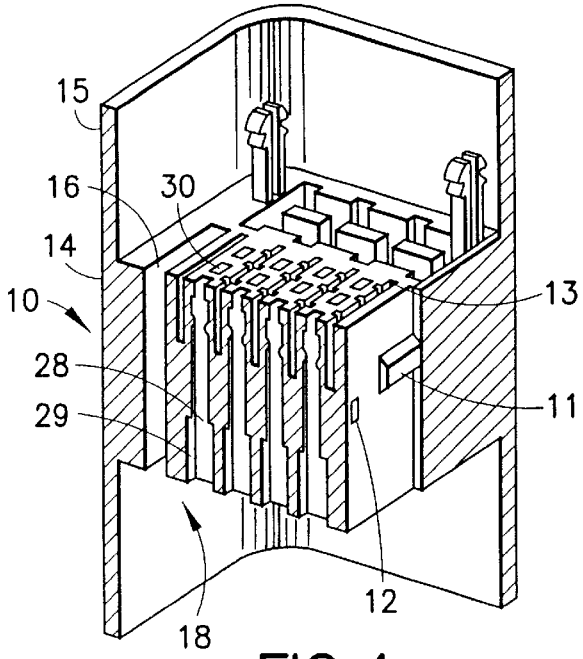
FIG.4
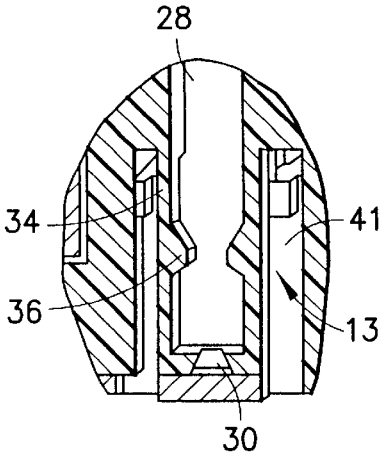
FIG.5a
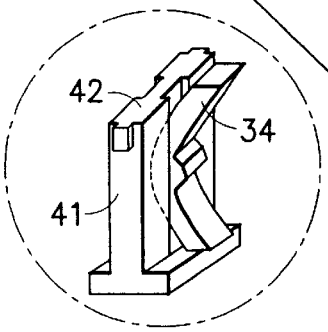
FIG.5c
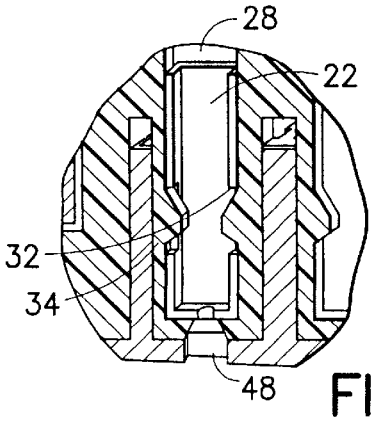
FIG.5b
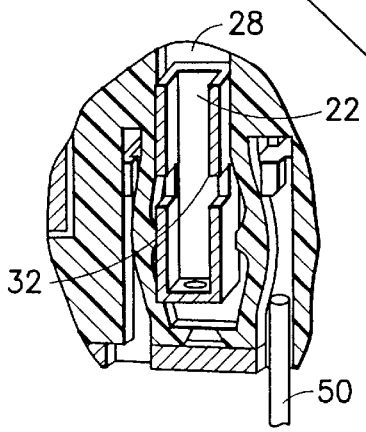

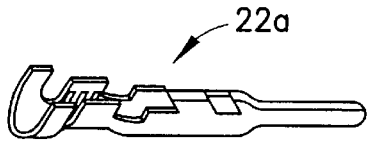
FIG.6a
FIG.6b
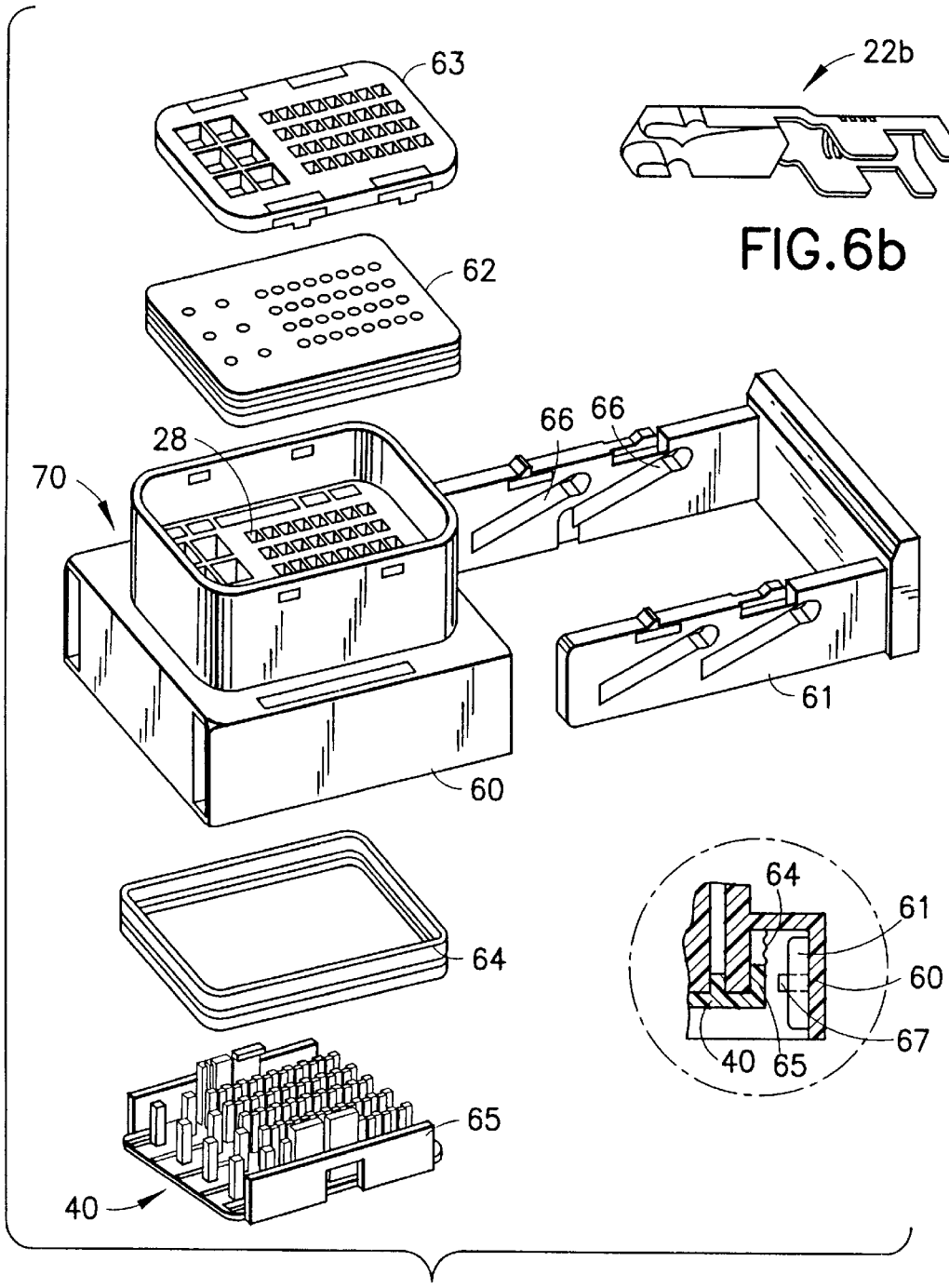
FIG.7

ELECTRICAL CONNECTOR WITH LOCKING OF THE CONTACT TERMINALS

BACKGROUND OF THE INVENTION

The present invention relates to electrical connectors of the type comprising an insulating casing having at least one row of cavities that are intended to accommodate contact terminals inserted from the rear of the casing.

Connectors of this kind are already known, in which the terminals have a window for accommodating a resilient catch made in one wall of the cavities, which catch snaps into the window at the end of the insertion of the terminal.

The locking thus obtained is of the permanent type in that a tool is needed to release the catch from the window. Moreover, it is known to complete this locking, called primary locking, with a secondary locking reinforcing the primary locking in order to increase the retention force of the terminal in the cavity. Such a locking mechanism, suited to terminals of the female-contact type, to be crimped onto a wire, or to insulation displacement connection, is known for example from patents EP 0,310,487 and EP 0,525,171, for which the secondary locking is achieved by a grid which is longitudinally insertable and contains the cavities on the front of the connector.

However, the permanent nature of the primary locking, although completely satisfactory for most applications in the connector field, may be problematic either in the case of connectors for which certain cavities must not accommodate terminals and/or for which a wiring error cannot be corrected without destroying the catch, or in the case where the cost of changing the connector would be greater than the cost of redoing the wiring.

Patent Application FR 2,754,943 describes a connector provided with a primary locking mechanism for the female contacts, for which at least one of the walls of the cavities accommodating the contact terminals has an elongate thin, region separated from the rest of the wall by slots parallel to the direction of insertion of the contacts into the cavities, this thin region being provided with an internal lug to be engaged in a window in a contact terminal.

SUMMARY OF THE INVENTION

The object of the present invention is to provide an electrical connector provided with a double locking mechanism, which meets the practical requirements better than those known hitherto, especially in that it allows the connector to be made more compact in that it makes it easier to detect that one or more contacts have been inserted incorrectly and in that it allows a contact terminal to be extracted without the risk of it being damaged, To this end, the invention also proposes an electrical connector provided with a casing having cavities for accommodating female contact terminals, at least one of the walls of which cavities accommodating the contact terminals has an elongate thin region forming a column separated from the rest of the wall by slots parallel to the direction of insertion of the contact terminals into the cavities, this column being provided with an internal lug to be engaged in a window in one of the terminals. the connector being provided with secondary locking means for the contact terminals, these secondary locking means consisting of studs which can be moved perpendicular to the direction of insertion of the contact terminals between a parted position of the columns and a bearing position of the columns.

The electrical connector according to the invention is thus provided with a casing having peripheral external side walls, a front face and a rear face as well as at least one row of cavities, accommodating female contact terminals, provided with first holes emerging in the front face of the casing, at least one of the walls of which cavities has at least one elongate thin region forming a column separated from the rest of the wall by slots parallel to the direction of insertion of the contact terminals into the cavities, this thin region being provided with an internal lug to be engaged in a window in the terminals, the connector being furthermore provided with secondary locking means for the contact terminals, these secondary locking means consisting of studs which can be moved perpendicular to the direction of insertion of the terminals between a parted position of the columns and a bearing position of the columns.

Advantageously, the connector may include at least one trench arranged along the row of cavities, the columns lying on the walls of the cavities facing the trench, the trench accommodating the studs and defining a channel for insertion and for lateral movement of the studs, in a direction parallel to the side walls provided with the columns and orthogonal to the direction of insertion of the contacts.

In an advantageous embodiment, the studs are mounted on the rear face of a front grid placed so as to slide on the front face of the casing and able to move between a so-called first position for inserting/extracting the terminals and a so-called second position for locking the terminals.

The studs may be joined together in rows by bridging pieces, the front grid may include second holes for making a passage for the contact terminations of male contact terminals of a complementary connector, these second holes being misaligned axially with the first holes in the position for inserting/extracting the terminals and aligned axially with the first holes in the position for locking the terminals.

The grid may include guide flanges and the casing front openings 16 accommodation of these flanges.

In order to hold the grid in position, at least one of the guide flanges may be provided with a tooth Intended to engage with a guide rail placed on one of the walls of the front openings in order to provide sliding keying means for holding the grid in position on the front face (20) of the casing.

At least one of the guide flanges may advantageously be provided with vertical grooves which, by engaging with a boss located on one of the walls of the front openings, define two lateral stable positions of the grid.

Preferably, in the so-called position for inserting/extracting the terminals, the studs are positioned opposite the partitions separating the cavities of the same row and flank the columns and, particularly advantageously, in the so-called position for locking the terminals, the columns are retained rearwards by the studs.

BRIEF DESCRIPTION OF THE DRAWINGS

The above characteristics as well as others will become clearer on reading the description which follows of a particular embodiment, given by way of non-limiting example, the description referring to the drawings which accompany it, in which:

FIG. 4 is an exploded view of a casing according to the invention;

FIGS. 5*a,* 5*b,* 5*c* are details of the primary and secondary locking device according to the invention in the following states: position for inserting/extracting a contact terminal; position in which a contact is correctly inserted with secondary locking; position in which a contact is incorrectly inserted, respectively;

FIGS. 6*a* and 6*b* an example of male and female contact terminals which can be used with a connector casing according to the invention;

FIG. 7 An example of an application of the invention to a connector with a yoke.

DETAILED DESCRIPTION OF THE INVENTION

Figure 1:
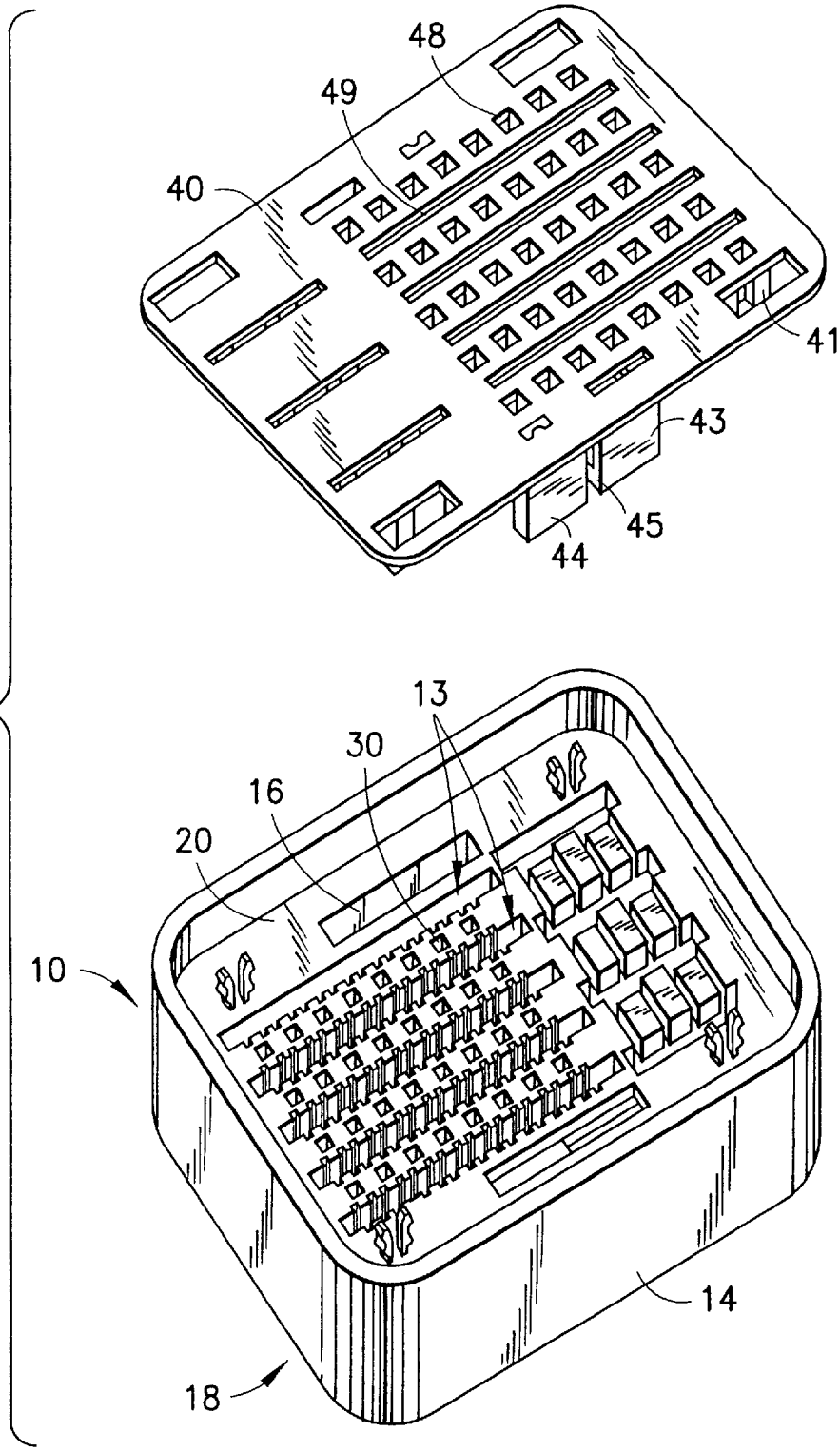
FIG. 1 is a perspective view showing a connector casing according to the invention, as well an a secondary locking grid according to the invention.
Figure 2:
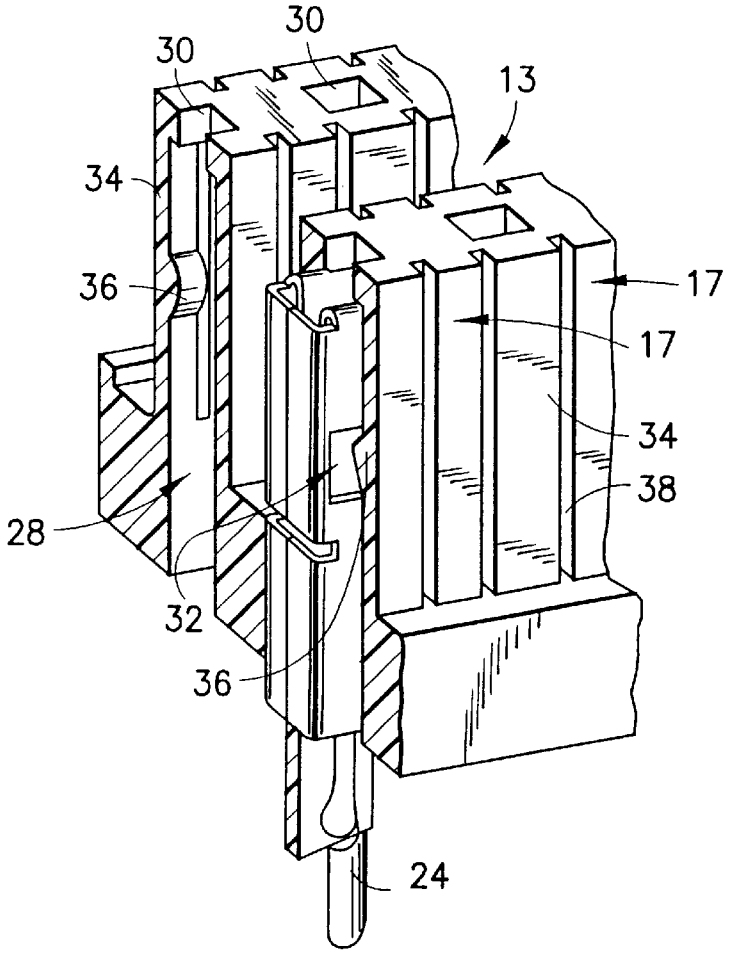
FIG. 2 is a perspective view of a detail of the casing on a large scale, showing the arrangement of a terminal in the casing.
Figure 3:
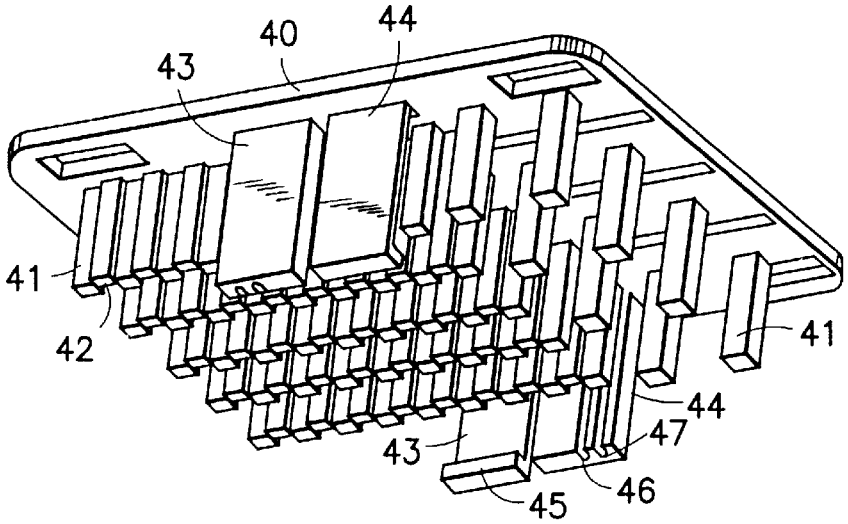
FIG. 3 is a perspective view of the grid in FIG. 1, from below.

The electrical connector shown in FIG. 1 has a casing 10 made of insulating material.

The casing 10 has, in the example shown diagrammatically, a parallelepipedal general shape with a rectangular cross section. It may be regarded as having peripheral external side walls 14, a front face 20 and a rear face 18. The external side walls may possibly be extended by a front skirt 15. The rear face 18 conventionally has the points of entry 29, into cavities for accommodating contact terminals 22, 22*a*, 22*b*, such as those seen for example in FIGS. 6*a*, 6*b*, and their connection wires 24, the contacts being inserted via these points of entry into the cavities. These points of entry into the cavities may, in a known manner, include an enlarged region for accommodating a seal surrounding the wire connected to the contact. One or more rows of cavities are provided in the casing. Each cavity is formed by internal walls 28 and the cavities of the same row are separated by partitions 17. In the embodiment illustrated, intended for female contact terminals of the cage type, first holes 30 are made in the front face for making a passage for the contact terminations of male contact terminals of a complementary connector and the front face of each contact terminal 22 bears on the front wall around a respective hole.

Each of the contact terminals 22 may have a general construction of the type described in document EP-A-0,310,487. A rectangular opening 32 is made in one of the side walls (or, better still, in both side walls, so as to allow the terminal of the front part of each terminal to be turned round). This opening 32 is intended to accommodate a primary locking lug forming art of a catch which will be described later.

According to the invention, trenches 13 are made between the rows of cavities and between the outermost rows of cavities and the walls of the casing. In the case of a connector having a single row, a single trench or two trenches is/are placed on one side or on each side of the row. The side walls of the cavities parallel to the trenches 13 have thin regions 34 forming elongate columns in the direction of insertion of the terminals, each column being provided with an internal lug 36. Each of these regions is placed opposite a terminal passage. Each region is bounded laterally by two parallel slots 38. The length of the slots and the thickness of the regions are such that the regions are flexible enough to form catches for the primary resilient locking of the terminals.

Advantageously, the lugs 36 have a greater slope at the front than at the rear, so that the force which is presented in opposition to the insertion of a terminal is less than that which is presented in opposition to its possible removal, without, however. preventing complete removal. It should be noted that the lugs 36 are produced during the moulding of the casing by impressions in a half-mould and can be forcibly removed from the mould.

In one embodiment of the invention, the trenches 13 are intended to accommodate studs 41 mounted on the rear face of a front grid 40. Advantageously, the studs may be joined together in rows by bridging elements 42 so as to stiffen them. The trenches in the casing 10, which are intended to accommodate the studs, thus define channel for insertion and for lateral movement of the studs, in a direction parallel to the aide walls provided with the columns 34, and orthogonal to the direction of insertion of the contacts. The front grid 40 has second holes 48 for passage of the male pins of a complementary connector.

In the embodiment illustrated, the casing 10 has, in addition to the trenches 13, front openings 16. 35 These front openings are intended to accommodate guide flanges 43, 44. The guide flanges 43 are provided with teeth 45 intended to engage with guide rails 11 located on one of the walls of each front opening 16 in order. to provide sliding keying means provided for keeping the grid 40 in position plated on the front face 20 of the casing, while still allowing it to slide over the front face of the casing.

When the grid is being inserted into the casing, the flanges 43 move apart resiliently when the teeth 45 pass along the rails 11 and then return to the vertical position, the teeth coming into abutment against the underside of the rails.

The guide flanges 44 themselves are provided with vertical grooves 46, 47 which, by engaging with a boss 12 which is itself located on one of the walls of the front openings 16, define two lateral stable positions of the grid during its lateral movement on the front face of the casing.

The way in which the connector is mounted stems directly from the foregoing.

First of all, the grid 40 is inserted into the casing 10 in the position corresponding to FIG. 5*a,* called the position for inserting/extracting the terminals. In this position, the studs 41 are positioned opposite the partitions 17 separating the cavities of the same row. Moreover, in this position, the second holes 48, for passage of the complementary male contact terminations of the contact terminals 22, are offset laterally with respect to the first holes 30 in the casing. In this position, it is therefore impossible to insert a complementary connector casing. When a contact 22 is being inserted, the catch or lugs 36 of the cavity are pushed back and the columns 34 arranged between two studs may bend rearwards (as may be seen in FIG. 5*c*). The contact is thus inserted until it is in a position in which its openings 32 are locked by the corresponding catch 36.

Each terminal in turn may be inserted into the module from the rear. In this position, the contact terminals may be removed from the casing.

When all the contact terminals have been inserted, the grid is pushed laterally until it is in the position shown in FIG. 5*b*.

In this position. the studs 41 are behind the columns 34. Thus, the columns 34 are retained rearwards by the studs 41. In the case of studs arranged between two rows of cavities, the studs 41 fit between the columns of two cavities in the adjacent rows.

The studs thus constitute a secondary locking mechanism for the terminals 22, providing opposition, in a positive manner and no longer only in a resilient manner, to the withdrawal of the terminals 22. In addition, in this position, the second passage holes 48 in the grid and the first passage holes 30 in the casing are aligned, thereby allowing the terminals 22 to be mated with the male contacts carried by a complementary connector.

In the case or one or more of the terminals is not fully in place, the corresponding column or column 34 remains in the rearwardly bent position as seen in FIG. 5*c* and is blocked between two adjacent studs, thereby preventing lateral movement of the grid and leaving it in a position in which mating of the complementary connector is precluded.

It should be noted that the invention can also be used on a connector having only a single row of contacts. In this case, the grid could be U-shaped, the studs being between the row of contact and the external wall of the front openings 16. Likewise, it may be that only one column carries a catch per contact.

In order to produce the studs and the bridging pieces 42, the grid has openings 49, which emerge here in a groove, allowing passage of moulding pins placed on the upper half of the mould for the grid.

Advantageously, these openings may serve, in the position for inserting/extracting the contacts, for inserting test prods in order to check whether the catches are correctly inserted into the windows 32. Such a test prod is shown diagrammatically in FIG. 5*c,* butting up against the column obstructing the trench 13. In this case, the incorrect insertion of the contact 22 will be detected and the connector will be able to be inspected.

FIG. 7 shows an application of the invention to a connector casing with locking using a yoke known elsewhere. This connector casing 70 has, in the rear part, a seal or grommet 62 which protects the points of entry into the cavities 28, a rear grid 63 closing off the casing, an external skirt 60 accommodating the arms of a locking yoke 61 provided with ramps 66 intended to engage with the locking pins such as the pins 67 of the casing in FIG. 1, as well as an interfacial seal 64 obtained by an external partition 65 of the grid 40 and intended, by engaging with the skirt 15 of the casing in FIG. 1, to seal the interface between the casings (10, 70). The types of connector casings and of contacts shown are non-limiting examples of use of the invention, and application to any type of electrical connector can be envisaged.

What is claimed is:

1. An electrical connector provided with a casing (10) having peripheral external side walls (14), a front face (20) and a rear face (18) and having at least one row of cavities, which are intended to accommodate female contact terminals (22), provided with first holes (30) emerging in the front face (20) of the casing, and the row of cavities has at least one wall (28) which has at least one resiliently flexible column (34) connected at top and bottom to the wall and separated from adjoining portions of the wall by slots (38) parallel to a direction of insertion of the contact terminals (22) into the cavities, the column being provided with an internal lug (36) to be engaged in a window (32) in the respective terminal wherein the connector is furthermore provided with secondary locking means for locking the contact terminals, the secondary locking means comprising studs (41) which can be moved perpendicular to the direction of insertion of the terminals between a parted position of the column and a bearing position of the column.

2. The connector according to claim 1, wherein the casing includes at least one trench (13), arranged along the row of cavities, and includes a number of columns corresponding to cavities in the row of cavities, the columns lying on side walls of the cavities facing the trench, the trench accommodating the studs (41) and defining a channel for insertion and for lateral movement of the studs, in a direction parallel to the side walls provided with the columns (34) and orthogonal to the direction of insertion of the contacts.

3. (Amended) The connector according to claim 2, wherein the studs (41) are mounted on the rear face of a front grid (40), the front grid can be placed so as to slide on the front face (20) of the casing (10) and is able to move between a first position for inserting/extracting the terminals and a second position for locking the terminals.

4. The connector according to claim 3, wherein the studs are joined together in rows by bridging pieces(42).

5. The connector according to claim 3 wherein the front grid (40) includes second holes (48) for making a passage for coupling of male contact terminals of a complementary connector, the second holes being misaligned axially with the first holes (30) in the position for inserting/extracting the male terminals and aligned axially with the first holes (30) in the position for locking the terminals.

6. The connector according to claim 3 wherein the casing includes front openings for accommodating guide flanges arranged under the grid.

7. The connector according to claim 6, wherein at least one of the guide flanges is provided with a tooth (45) intended to engage with a guide rail (11) placed on a wall of at least one of the front openings (16) in order to provide sliding keying means for holding the grid (40) in position on the front face (20) of the casing.

8. The connector according to claim 6, wherein at least one of the guide flanges is provided with a vertical groove (46, 47) which, by engaging with a boss (12) located on a wall of each of the front openings (16), define two lateral positions of the grid on the front face of the casing.

9. The connector according to claim 3, wherein in the first position for inserting/extracting the terminals, the studs (41) are positioned opposite partitions (17) separating the cavities in the row of cavities and flanking the columns (34).

10. The connector according to claim 3, wherein, in the second position for locking the terminals, the columns (34) are retained rearwards by the studs (41).

11. An electrical connector comprising:

a casing with a front face, a rear face and sidewalls extending therebetween, the casing including a row of cavities for accommodating contact terminals therein, the cavities having openings in the front face of the casing, wherein the row of cavities has at least one wall with a resiliently flexible column formed therein by slots in the wall which are parallel to a direction of insertion of the contact terminals into the cavities, said column being connected at least at opposite ends of the column to adjoining portions of the wall and being provided with an internal lug for engaging the contact terminals; and a grid element mounted on the front face of the casing for sliding on the front face from a first position to a second position, the grid element comprising studs depending therefrom into the casing, the studs are moved by sliding the grid element from the first position to the second position, wherein in the second position the studs are located to hold the column engaged to a corresponding contact terminal; and wherein the front face of the casing has openings for accommodating guide flanges depending from the grid element, at least one of the guide flanges having a tooth for engaging a guide rail on a wall of one of the openings.

* * * * *